United States Patent [19]

Noguchi et al.

[11] Patent Number: 4,935,777

[45] Date of Patent: Jun. 19, 1990

[54] METHOD OF STABILIZING SURFACE POTENTIAL OF PHOTORECEPTOR FOR ELECTROPHOTOGRAPHY

[75] Inventors: Teruhiko Noguchi, Osaka; Yuji Okamoto; Yoshiharu Tsujimoto, both of Nara; Hiroshi Kinashi, Kyoto; Yuhi Yui, Osaka; Itaru Kawabata, Osaka; Tooru Nakata, Osaka; Jitsuo Masuda, Nara, all of Japan

[73] Assignee: Sharp Kabushiki Kaisha, Osaka, Japan

[21] Appl. No.: 221,666

[22] Filed: Jul. 20, 1988

[30] Foreign Application Priority Data

| | | | |
|---|---|---|---|
| Jul. 21, 1987 | [JP] | Japan | 62-181696 |
| Jul. 21, 1987 | [JP] | Japan | 62-181697 |
| Jul. 21, 1987 | [JP] | Japan | 62-181698 |
| Jul. 21, 1987 | [JP] | Japan | 62-181699 |
| Jul. 21, 1987 | [JP] | Japan | 62-181700 |

[51] Int. Cl.[5] ..... G03G 21/00

[52] U.S. Cl. ..... 355/210; 355/219; 355/77; 430/31

[58] Field of Search ..... 355/210, 228, 77, 214, 355/219; 430/31, 494

[56] References Cited

U.S. PATENT DOCUMENTS

| | | | |
|---|---|---|---|
| 4,256,401 | 3/1981 | Fujimura et al. | 430/31 X |
| 4,375,328 | 3/1983 | Tsuchiya et al. | 355/210 |
| 4,474,455 | 10/1984 | Hirakura et al. | 430/31 X |
| 4,538,900 | 9/1985 | Lutus et al. | 355/210 X |

*Primary Examiner*—R. L. Moses

*Attorney, Agent, or Firm*—Flehr, Hohbach, Test, Albritton & Herbert

[57] ABSTRACT

Before a photoreceptor for an electrophotographic image forming apparatus is uniformly charged at the beginning of a process for forming a latent electrostatic image thereon, the photoreceptor is exposed to charge-removing light for stabilizing the surface potential such that a high-quality image can be obtained. The level of exposure is modified in view of the fatigue and recovery characteristics of the photoreceptor. During a continuous operation of the photoreceptor, the level is logarithmically reduced. When the photoreceptor is started again after a rest period, the initial level of exposure is adjusted by logarithmically increasing it according to the length of the rest period as well as in view of the level of exposure prior to the rest period.

9 Claims, 8 Drawing Sheets

| $t_R$(SEC) \ $t_O$(SEC) | 0~4<br>4<br>(A) | 4.1~8.0<br>4<br>(B) | 8.1~14.0<br>6<br>(C) | 14.1~26.0<br>12<br>(D) | 26.1~46.0<br>20<br>(E) | 46.1~82.0<br>36<br>(F) | 82.1~147.0<br>65<br>(G) | 147.1~264.0<br>117<br>(H) | 264.1~472.0<br>208<br>(I) | 472.0~<br>(J) |
|---|---|---|---|---|---|---|---|---|---|---|
| 0~60<br>60 (1) | | | | | | | | | | 1/40 |
| 60~114<br>174 (2) | | | | | | | | | 1/30 | 1/40 |
| 174~120<br>294 (3) | | | | | | | | 1/24 | 1/30 | 1/40 |
| 294~204<br>498 (4) | | | | | | | 1/20 | 1/24 | 1/30 | 1/40 |
| 498~348<br>846 (5) | | | | | | 1/17 | 1/20 | 1/24 | 1/30 | 1/40 |
| 846~594<br>1440 (6) | | | | | 1/15 | 1/17 | 1/20 | 1/24 | 1/30 | 1/40 |
| 1440~1002<br>2442 (7) | | | | 1/13 | 1/15 | 1/17 | 1/20 | 1/24 | 1/30 | 1/40 |
| 2442~1710<br>4152 (8) | | | - 1/12 | 1/13 | 1/15 | 1/17 | 1/20 | 1/24 | 1/30 | 1/40 |
| 4152~3048<br>7200 (9) | | 1/11 | 1/12 | 1/13 | 1/15 | 1/17 | 1/20 | 1/24 | 1/30 | 1/40 |
| 7200~<br>(10) | 1/10 | 1/11 | 1/12 | 1/13 | 1/15 | 1/17 | 1/20 | 1/24 | 1/30 | 1/40 |

FIG.-2

| A / B | $t_O$ / $t_R$ | 4 | 3 | 2 | 1 | 0 |
|---|---|---|---|---|---|---|
| | | 8 | 18 | 56 | 182 | < |
| 0 | 174 | | | | | 1/40 |
| 1 | 324 | | | | 1/20 | /40 |
| 2 | 942 | | | 1/13 | 1/20 | 1/40 |
| 3 | 2712 | | 1/10 | 1/13 | 1/20 | 1/40 |
| 4 | - ^ | 1/0 | 1/10 | 1/13 | 1/20 | 1/40 |

FIG. — 3

| PERIOD / $t_R$(SEC) | (A) | (B) | (C) | (D) | (E) | (F) | (G) | (H) | (I) | (J) |
|---|---|---|---|---|---|---|---|---|---|---|
| 0 ~ 60 / 60 (1) | | | | | | | | | | 0 ~ 1/40 |
| 60 ~ 114 / 174 (2) | | | | | | | | | 0~472.0 472 1/30 | 472.1~ 1/40 |
| 174 ~ 120 / 294 (3) | | | | | | | | 0~22.0 22 1/24 | 22.1~472.0 450 1/30 | 472.1~ 1/40 |
| 294 ~ 204 / 498 (4) | | | | | | | 0~8.0 8 1/20 | 8.1~61.0 53 1/24 | 61.1~472.0 411 1/30 | 472.1~ 1/40 |
| 498 ~ 348 / 846 (5) | | | | | | 0~5.0 5 1/17 | 5.1~22.0 17 1/20 | 22.1~101.0 79 1/24 | 101.1~472.0 411 1/30 | 472.1~ 1/40 |
| 846 ~ 594 / 1440 (6) | | | | | 0~4.0 4 1/15 | 4.1~12.0 8 1/17 | 12.1~40.0 28 1/20 | 40.1~138.0 98 1/24 | 138.1~472.0 334 1/30 | 472.1~ 1/40 |
| 1440 ~ 1002 / 2442 (7) | | | | 0~4.0 4 1/13 | 4.1~8.0 4 1/15 | 8.1~22.0 14 1/17 | 22.1~61.0 39 1/20 | 61.1~169.0 108 1/24 | 169.1~472.0 303 1/30 | 472.1~ 1/40 |
| 2442 ~ 1710 / 4152 (8) | | | 0~4.0 4 1/12 | 4.1~8.0 4 1/13 | 8.1~14.0 6 1/15 | 14.1~34.0 20 1/17 | 34.1~81.0 47 1/20 | 81.1~196.0 135 1/24 | 196.1~472.0 276 1/30 | 472.1~ 1/40 |
| 4152 ~ 3048 / 7200 (9) | | 0~4.0 4 1/11 | 4.1~8.0 4 1/12 | 8.1~14.0 6 1/13 | 14.1~22.0 8 1/15 | 22.1~47.0 25 1/17 | 47.1~101.0 54 1/20 | 101.1~219.0 118 1/24 | 219.1~472.0 253 1/30 | 472.1~ 1/40 |
| 7200 ~ (10) | 0~4 4 1/10 | 4.1~8.0 4 1/11 | 8.1~14.0 6 1/12 | 14.1~26.0 12 1/13 | 26.1~46.0 20 1/15 | 46.1~82.0 36 1/17 | 82.1~147.0 65 1/20 | 147.1~264.0 117 1/24 | 264.1~472.0 208 1/30 | 472.1~ 1/40 |

FIG.-5

| B \ A | $t_R$ | 4 | 3 | 2 | 1 | 0 |
|---|---|---|---|---|---|---|
| 0 | $t_0$ | | | | | V |
| | 174 | | | | | 1/40 |
| 1 | $t_0$ | | | | 251 | V |
| | 324 | | | | 1/20 | 1/40 |
| 2 | $t_0$ | | | 16 | 235 | V |
| | 942 | | | 1/13 | 1/20 | 1/40 |
| 3 | $t_0$ | | 6 | 33 | 212 | V |
| | 2712 | | 1/10 | 1/13 | 1/20 | 1/40 |
| 4 | $t_0$ | 4 | 12 | 47 | 188 | V |
| | A | 1/8 | 1/10 | 1/13 | 1/20 | 1/40 |

FIG.-6

METHOD OF STABILIZING SURFACE POTENTIAL OF PHOTORECEPTOR FOR ELECTROPHOTOGRAPHY

BACKGROUND OF THE INVENTION

This invention relates to a photoreceptor for electrophotography for forming thereon an electrostatic latent image by a potential difference on its surface and more particularly to a method of stabilizing the surface potential of such a photoreceptor when it is uniformly charged at the beginning of an image forming process.

The surface of a photoreceptor for electrophotography such as those of a copier or a laser printer is uniformly charged to a potential of about 600–800 V before any electrostatic latent image is formed thereon. After an electrostatic latent image is formed by exposure of such a surface to an image forming beam of light, it is developed with toner to become a visible image which is thereafter transferred onto a copy paper sheet. In such an image forming process, uniformity in the photoreceptor potential significantly affects the quality of the image which is formed. If the photoreceptor surface potential is not uniform, or otherwise not appropriate, what are known as ghosts may appear in the formed image or the image density may turn out to be insufficient. In view of the above, it is currently a common practice to provide some optical fatigue to the photoreceptor by exposing its surface to a beam of charge-removing light prior to the process of uniform charging so as to stabilize the surface potential.

Optical fatigue gradually advances as a photoreceptor is used constantly in an image forming process but the photoreceptor gradually recovers from the fatigue by resting, that is, by remaining unused. According to conventional methods of stabilizing the surface potential by charge-removing light, however, a photoreceptor is always exposed to a same amount of charge-removing light. As explained above, a photoreceptor surface is in different conditions of optical fatigue, depending, for example, on whether it has been continuously in use or it has been unused for a long time. With such conventional methods by exposure to charge-removing light, therefore, photoreceptor surface potential cannot be kept at a uniform level.

Japanese Patent Publications Tokko 49-4337 and Tokkai 57-147782 disclosed methods of varying exposure to charge-removing light according to the period of rest but there was no proposal for control during a continuous operation or regarding periods of rest with power switched off. In other words, these publications did not teach how to control the exposure to charge-removing light although optical fatigue of a photoreceptor changes during a continuous use. Moreover, since prior art image forming apparatus are not provided with any timing means operating while power is switched off, they must either ignore rest periods while power is off or assume that the photoreceptor is completely recovered from fatigue whenever power is switched on after a period of rest, no matter how short. Those of the former type would have to somehow record the degree of fatigue immediately before power is switched off and there is a risk of erroneous correction after a long rest period. Those of the latter type, on the other hand, run the risk of insufficient correction when power has been off for only a short period.

SUMMARY OF THE INVENTION

It is therefore an object of the present invention to provide a method of stabilizing surface potential of a photoreceptor for electrophotography when it is uniformly charged at the beginning of a copying operation.

More particularly, it is an object of the present invention to provide a method of varying exposure of such a photoreceptor to charge-removing light according to its fatigue and recovery characteristics.

The above and other objects of the present invention can be achieved by adjusting the duty ratio of a charge-removing lamp at the beginning of an operation, depending on the length of the preceding rest period as well as the duty ratio set therefor before this rest period, and gradually decreasing the duty ratio during a continuous operation. When the operation is stopped, the duty ratio is reduced by a specified amount such that the effect of recovery can be properly taken into account when the operation is thereafter restarted. In order to further uniformize the potential independently of the prior photoreceptor condition, the charge-removing lamp is operated at full duty to completely fatigue the photoreceptor immediately after power is initially switched on.

BRIEF DESCRIPTION OF THE DRAWINGS

The accompanying drawings, which are incorporated in and form a part of the specification, illustrate embodiments of the present invention and, together with the description, serve to explain the principles of the invention. In the drawings:

FIG. 5 is another duty ratio table to be stored in the ROM shown in FIG. 1, FIG. 6 is a simplified duty ratio table for explaining the difference between the tables shown in FIGS. 2 and 5.

DETAILED DESCRIPTION OF THE INVENTION

The present invention is based on the observation that optical fatigue of a photoreceptor surface changes logarithmically and that its recovery by resting is described by a logarithmically varying curve which is steep in the beginning but gently sloped near the end. This is so because: (1) there is more charge remaining in deep energy states than in shallow energy states and the amount decreases logarithmically; (2) charge remains sequentially from shallow energy states; and (3) residual charge becomes freed sequentially from shallow energy states. If a photoreceptor is completely fatigued but is not allowed to completely recover before it is used again, the charge remaining in deep energy states are not released while new charge begins to fill shallow energy states. As a result, situations may arise where deep and shallow energy states are occupied but energy states in the middle are left unoccupied. In such a situation, recovery curves when charge is released from deep energy states and shallow energy states become discontinuous. Thus, preliminary exposure of a photoreceptor to charge-removing light before it is uniformly charged in preparation for an image forming process is gradually decreased according to the present invention when it is being used in a continuous operation because, in such a mode of operation, optical fatigue of its surface increases gradually, or logarithmically, as mentioned above. In this manner, the optical fatigue characteristic of the photoreceptor surface can be corrected such that the level of fatigue remains constant and the surface potential can be stabilized. When a photoreceptor is restarted after a rest period, its exposure to charge-removing light is increased, depending on the length of the rest period, from the level at the end of the previous operation. In this situation, exposure is increased quickly corresponding to a short rest until the level of the previous operation is reached and then gradually corresponding to a long rest. When exposure is increased, it is done logarithmically, that is, quickly in the beginning and slowing down thereafter in view of the different charge release characteristics from deep and shallow energy states.

Figure 1:
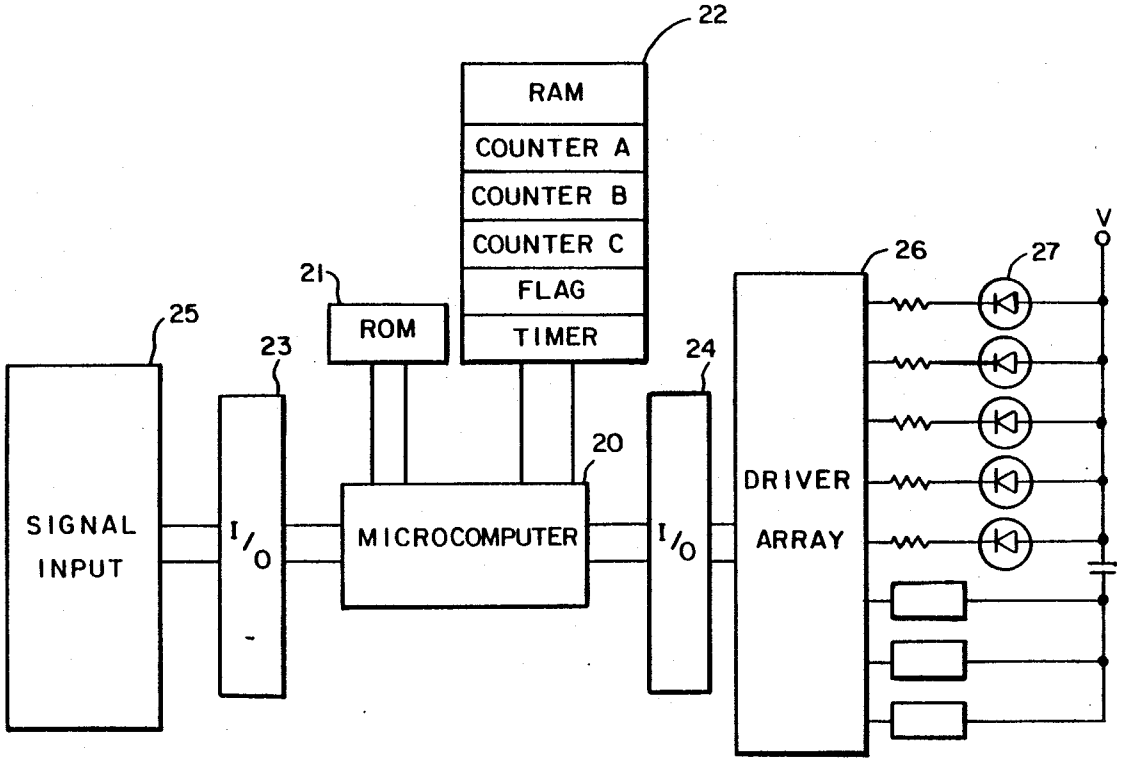
FIG. 1 a schematic block diagram of a control unit of a copier which uses a method embodying the present invention.

In what follows, the present invention is described by way of an example. As shown in FIG. 1 which is a schematic block diagram of a control unit of a copier using a method embodying the present invention, its charge-removing lamp 27 is controlled by a microcomputer 20 connected to a read-only memory ROM 21 storing control programs and a duty ratio table to be described in detail below and a random-access memory RAM 22 including counters A-C, a flag and a timer. This microcomputer 20 is also connected through interface circuits 23 and 24 to a signal input device 25 and a driver array 26. The signal input device 25 includes a main control unit for controlling the overall operation of the image forming apparatus and serves to transmit commands to switch the charge-removing lamp 27 on and off. The driver array 26 is for lighting the charge removing lamp 27 and the duty ratio of lighting can be increased and decreased by controlling the pulse width.

Figures 1, 4:
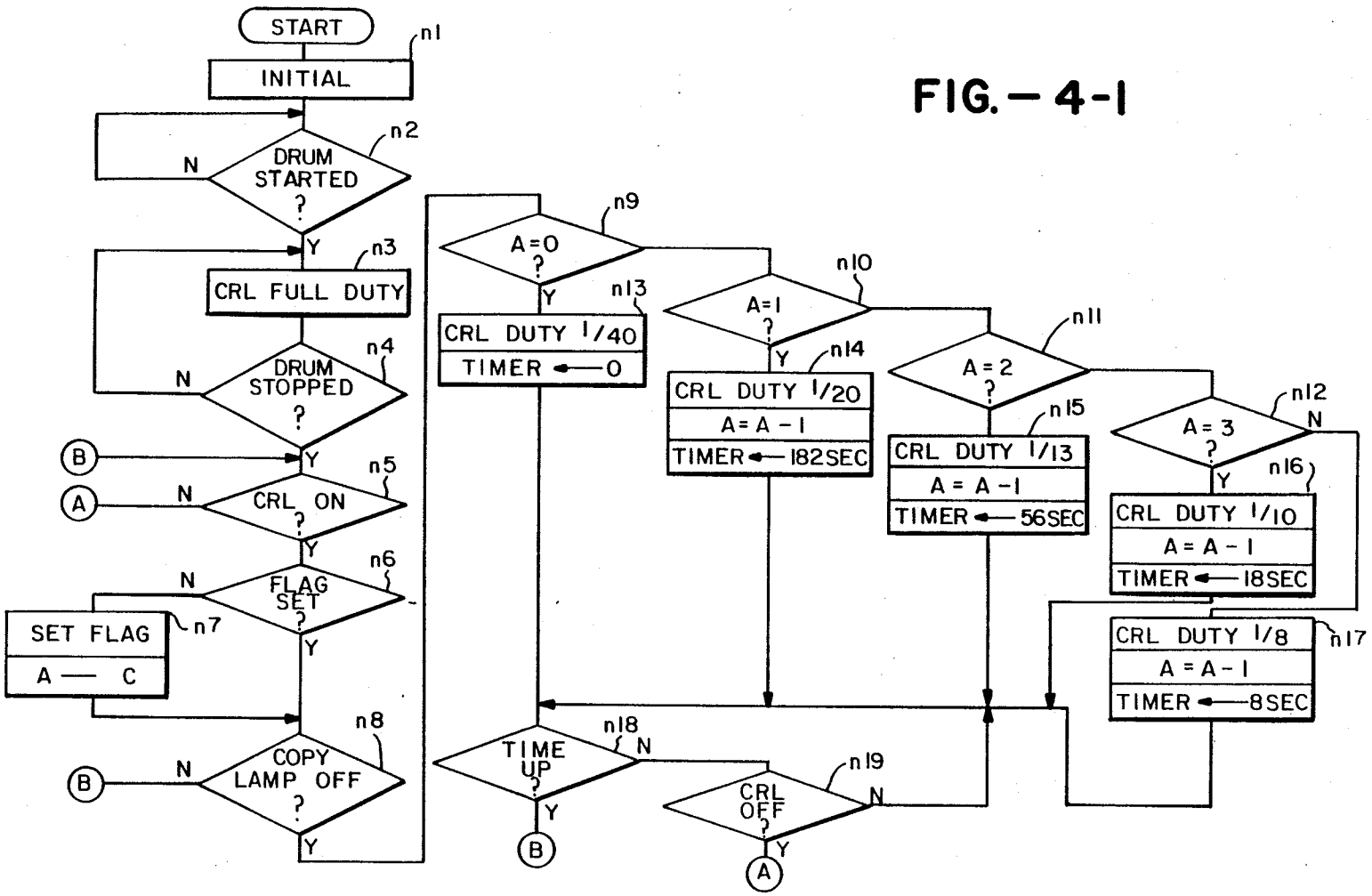
FIG. 4 is a flow chart of the operation of the control unit shown in FIG. 1 in connection with the duty ratio table shown in FIG. 3.
Figures 2, 4:
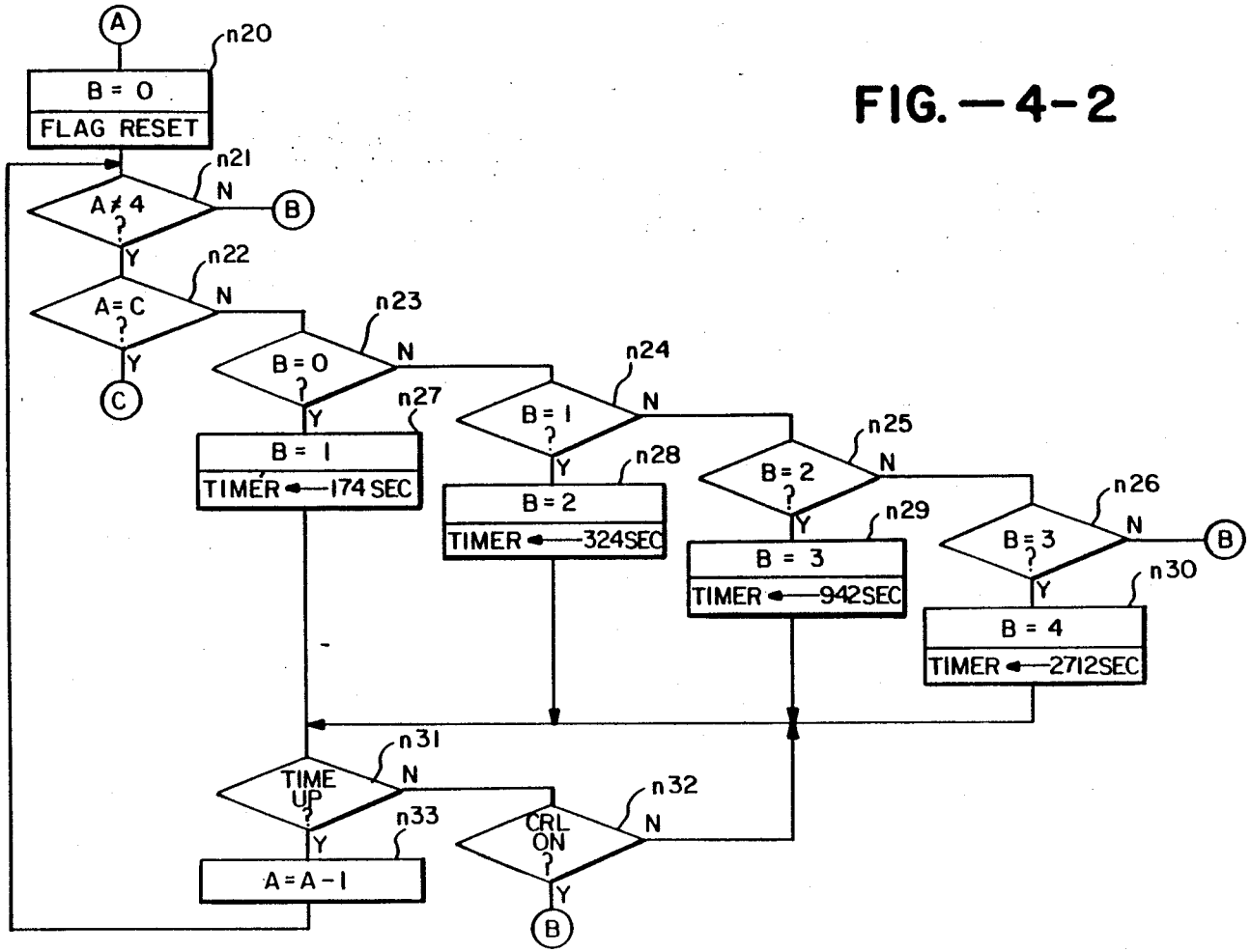
FIG. 2 is an example of duty ratio table to be stored in the ROM shown in FIG. 1.

FIG. 2 shows an example of duty ratio table stored in the ROM 21. The horizontal axis of this table represents time of continuous operation ($t_O$) and the vertical axis represents time of rest ($t_R$). The fractions shown in the table each represent the duty ratio of the charge-removing lamp 27 after the indicated time of continuous operation following a rest period of the indicated duration. Both the operation and rest periods (the horizontal and vertical axes) are partitioned into 10 segments, each time interval being represented by one segment varying logarithmically either in horizontal or vertical direction. As a result, the duty ratio of the charge-removing lamp 27 changes logarithmically both during a continuous operation and during a rest period, corresponding to the fatigue and recovery characteristics of the photoreceptor mentioned above. A logarithmic increase in the denominator of the duty ratio means a logarithmic decrease of the duty ratio as the operation time increases.

Next, a method of controlling the charge-removing lamp 27 based on this exemplary duty ratio table embodying the present invention is explained. During a warm-up period after the main switch (power switch) of the copier is switched on, the charge-removing lamp 27 is operated at full duty to completely fatigue the photoreceptor such that whatever condition the photoreceptor was in before the main switch was switched on is "erased" and the charging voltage at the beginning of operation can be stabilized. If the copier is going to be used immediately thereafter, the duty ratio is 1/40 (Entry 1J of FIG. 2) because the photoreceptor is completely fatigued and not much light is necessary. If the photoreceptor is left unused, however, it gradually recovers from the fully fatigued condition. The table is so designed that the duty ratio is increased according to the degree of recovery corresponding to the duration of the rest period. If an operation is started after a rest period of 500 seconds, for example, this corresponds to the 6th row. The initial duty ratio is 1/15 (Entry 6E) and exposure at this ratio continues for 20 seconds. Thereafter, the duty ratio is decreased according to the schedule on the same row. The decrease takes place between two successive exposure steps, not during an exposure step. In the case of the above example, the duty ratio is kept at 1/17 for a period of 36 seconds (6F) after the aforementioned initial period of 20 seconds, at 1/20 for a period of 65 seconds (6G) thereafter, at 1/24 for a period of 117 seconds (6H) thereafter, at 1/30 for a period of 208 seconds (6I) thereafter and at 1/40 (6J) thereafter.

Next, a situation where an operation is restarted after a short rest period is described. Let us assume that the copier was operated as in the example described above but only to Entry 6G and that it then rested for 30 minutes (1800 seconds). At the beginning of this rest period, the aforementioned counter A, serving as a pointer, points to Entry 3H and sets 1/24 as the duty ratio. It is because the duty ratio was already 1/20 (6G) when the copier was stopped and if 1/20 (4G) is set, overexposure will result. Thereafter, as the photoreceptor stays rested, the pointer shifts from 3H to 4G after 60 seconds, from 4G to 5F after 114 seconds and from 5F to 6E after 120 seconds. The charge which is released during this period is the residual charge accumulated during the immediately preceding operation in shallow energy states. This control will be referred to as floating time control.

Thereafter during the continuous rest period, residual charge from earlier operations is released from deeper energy states. Thus, recovery by the photorecptor becomes slower, corresponding to its recovery characteristics when it recovers from a completely fatigued condition. Thus, after the counter A comes to point Entry 6E, duty ratio is shifted according to the timing schedule on the corresponding row. For example, the duty ratio is changed from 1/15 (6E) to 1/13(7D) after 594 seconds and from 1/13 (7D) to 1/12 (8C) after 1002 seconds. This control will be referred to as fixed time control.

Thus, if the copier is operated again after the aforementioned rest period of 30 minutes, the duty ratio is set at 1/12 (8C). According to this exemplary duty ratio table, exposure times by the charge-removing lamp 17 at the individual duty ratios are the same whichever row of the table is followed. This is because the fatigue level of the photoreceptor is the same independently of the fatigue at the beginning of the operation.

As explained above, Counter A stored in the RAM 22 serves to remember the duty ratio currently set. Counter B serves to remember the current position in the table during a floating time control. Counter C is for remembering the duty ratio at the beginning of the preceding operation. The flag is for indicating whether the copier is in operation or not and the timer is for recording operation and rest times. Use is typically made of a timer which is initially set to a specified value and keeps reducing it until it is zero.

Figures 3, 4:
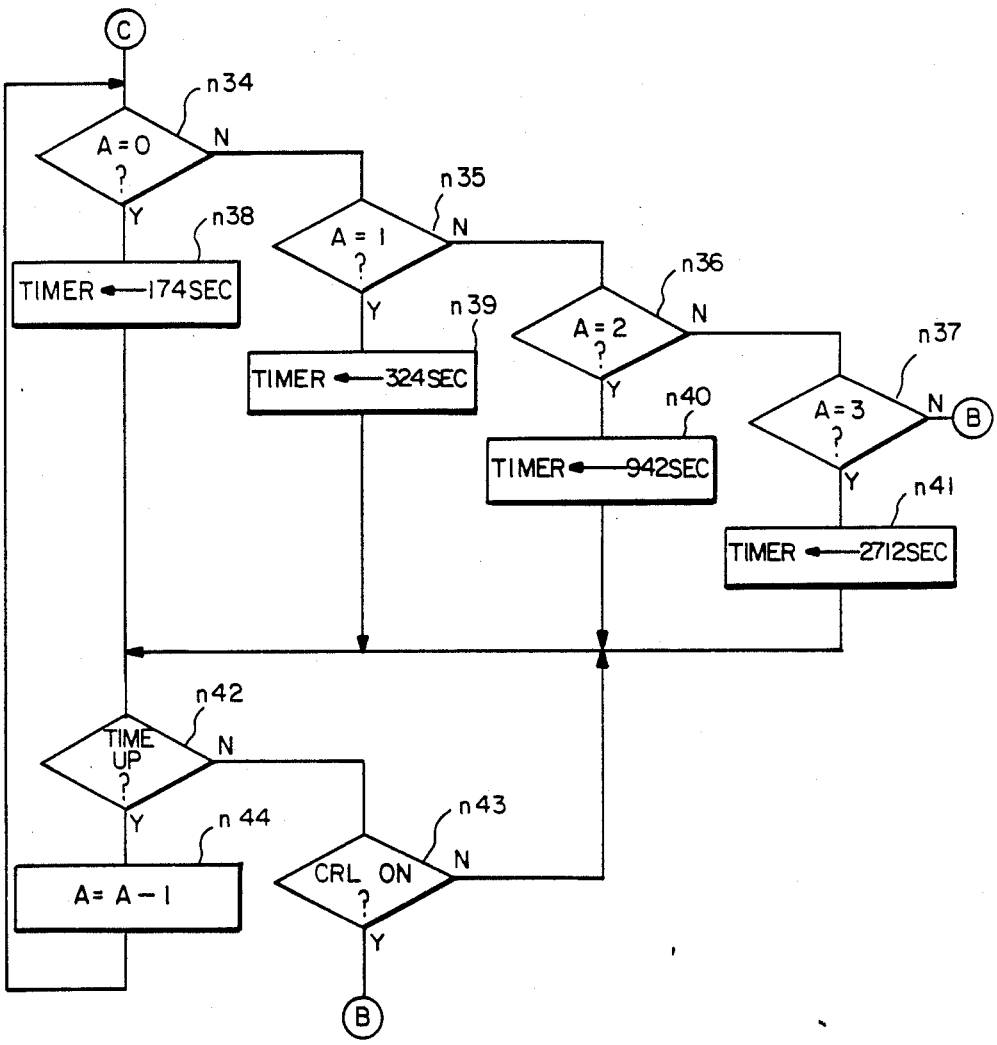
FIG. 3 is a simplified duty ratio table for explaining the principles of the present invention.

The operation of the aforementioned control unit is explained next. For simplifying the explanation, a simpler duty ratio table shown in FIG. 3 dividing time periods into five segments is considered and a flow chart shown in FIG. 4 corresponding to this table is referenced, but the explanation which follows is intended to describe the principles of the present invention and not to limit the scope thereof by the particular size of the table.

When the main switch is switched on, the control unit is initialized in a known manner (n1) and thereafter waits until the photoreceptor drum begins to rotate (n2). When the photoreceptor begins to rotate for a warmup, the charge-removing lamp 27 (CRL in the flow chart) is operated at full duty (n3) until the drum is stopped (n4), causing the photoreceptor to be completely fatigued. The copier is now ready, but waits until a user gives a command and the charge-removing lamp 27 is found in the ON condition again (n5). In the meantime, aforementioned Counter B for remembering the rest period and the flag are reset (n20) and, if Counter A for remembering duty ration (column number of the table in FIG. 3) stores 4 (NO in n21), the control unit goes back to Step n5 because the control level (duty ratio) cannot increase any further by waiting longer. If Counter A stores 4, the contents of Counters A and C are compared to decide whether a floating time control (n23–n33) or a fixed time control (n34–n44) should be carried out.

In a floating time control, the value in Counter B is examined. If it is 0 (YES in n23), it is incremented (increased by 1) and the timer is set to 174 sec corresponding to the first row of the duty ratio table of FIG. 3. If the copier is not started and hence the charge-removing lamp 27 is not found in the ON condition within the subsequent 174-second period (NO in n31 and n32 until YES in n31), this means that the first rest period according to the duty ratio table has passed and the value in Counter A is incremented to increase the duty ratio (n33) before the control unit goes back to Step n21. If the value in Counter B is 1, 2 or 3 (YES in n24, n25 or n26), instead, it is similarly incremented and the timer is set to 324 sec, 942 sec or 2712 sec, respectively, corresponding to the second, third and fourth row of the duty ratio table. If the charge-removing lamp 27 is switched on before the timer counts up its time (YES in n32), the control unit proceeds to Step n5 immediately.

In a fixed time control, the value in Counter A is similarly examined. If it is 0, 1, 2 or 3 (YES in n34, n35, n36 or n37 , the timer is set to 174 sec, 324 sec, 942 sec or 2712 sec (n38, n39, n40 or n41) corresponding to the first, second, third or fourth row of the table, respectively, and if the timer counts up its time before the charge-removing lamp 27 is switched on (YES in n42), the value in Counter A is increased by 1 to increase the duty ratio (n44). If the charge-removing lamp 27 is switched on before the timer counts up its time (YES in 43) or the value in Counter A reaches 0 and the duty ratio cannot be increased further, the control unit proceeds to Step n5.

When the user starts to operate the copier and the charge-removing lamp 27 is switched on (YES in n5), the flag is set (n7), if it is then reset (NO in n6), to indicate that the copier is now in operation. At the same time, the current value stored in Counter A indicative of the duty rate at the beginning of this copying operation is saved in Counter C. If the flag is already set (YES in n6), this means that the processes described above have already been done and the control unit waits until the copy lamp (not shown) of the copier goes off (YES in n8) so as not to allow the duty ratio to be changed during an on-going copying operation. Even if the copier is in a continuously operating mode, there are time intervals during which the copy lamp is off and Steps n9–n17 related to Counter A are carried out during such intervals.

After the copy lamp is switched off, if the value in Counter A is 1, 2, 3 (YES in n10, n11, n12) or 4 (NO in n12), the duty ratio is set to 1/20. 1/13, 1/10 or 1/8, the counter is set to 182 sec, 56 sec, 18 sec or 8 sec corresponding to the fourth, third, second or first column of the duty ratio table and the counter value is decremented by 1 (n14, n15, n16 and n17). Thereafter, the control unit waits until the timer counts up its set time (n18 and then proceeds to Step n5. If the charge-removing lamp 27 is switched on before the timer counts up its time (YES in n19), the on-going copying operation is interpreted as having ended and the control unit proceeds to Step n20.

Since the charge-removing lamp 27 is always switched on first at the beginning of a copying operation before other preparations are done and the copy lamp is switched on, the operations after Step n9 are carried out only after Steps n5, n6, n7 and n8 are completed. The content of Counter A is then examined and it is only after the duty ratio is set in accordance therewith that the value in Counter A is decremented. Thus, even if the copier is operated for only one copy and the charge-removing lamp 27 is switched off, the duty ratio is decremented by one step and the control unit goes from Step n19 to Step n20. In other words, even if the copier is operated only for a short time before it is stopped, the photoreceptor is fatigued and this change in fatigue must be properly taken into account in order to avoid overexposure by the charge-removing lamp 27. This is why a lower duty ratio value is set in Counter A at the end of an operation than the value during the operation.

In summary, duty ratio is gradually reduced during a continuous operation such that effects of photoreceptor fatigue can be corrected and the charging potential on the photoreceptor surface can be uniformly controlled. When there are rest periods interspersed between operations, the photoreceptor is gradually recovered from fatigue but the degree of recovery is also taken into account to provide an accurate correction program.

The foregoing description of a preferred embodiment of the invention, however, has been presented for purposes of illustration and description. It is not intended to be exhaustive or to limit the invention to the precise form disclosed, and many modifications and variations are possible in light of the above teaching. For example, the duty ratio table shown in FIG. 2 was prepared primarily to be best applicable where the copier has rested for more than two hours (7200 seconds). The table, therefore, can be further improved as will be described below and such improvements are also within the intended scope of the invention.

With reference to the table of FIG. 2, let us consider a situation where a copier was rested for two hours or longer and then continuously operated for 82–147 seconds. During this 65-second period, the duty ratio of the charge-removing light is 1/20 according to Entry 10G of FIG. 2. Compare this to a next situation where the copier was rested for 300 seconds such that the control unit looks to the fourth row of the table and initially sets the duty ratio also at 1/20 (4G). Since the photoreceptor fatigue is logarithmically recovered, if the 472-second period of continuous operation considered in the table of FIG. 2 is correctly divided into three intervals (like 4G, 4H and 4I) such that the changes in fatigue during these three intervals should be the same, this 472-second period should be partitioned not as shown in FIG. 2 but at $472^{\frac{1}{3}}$ (about 8) seconds and $472^{\frac{2}{3}}$ (about 61) seconds and 472 seconds. In other words, a better program in this case is to operate the charge-removing lamp at 1/20 duty for 8 seconds (instead of 65 seconds according to FIG. 2), at 1/24 duty for 53 seconds (instead of 117 seconds according to FIG. 2) and then at 1/30 for 411 seconds.

FIG. 5 shows an improved duty ratio table thus structured by determining time intervals to which periods of continuous operation after different rest periods are partitioned. Unlike with the table shown in FIG. 2, entries on the same column in the table shown in FIG. 5 do not represent the same time interval. For the convenience of explanation below of the operation of the control unit with such an improved duty ratio table, however, a simplified table shown in FIG. 6 with reduced numbers of intervals into which periods of continuous operation and rest periods are divided will be used, as done above with FIGS. 3 and 4.

Figure 7A:
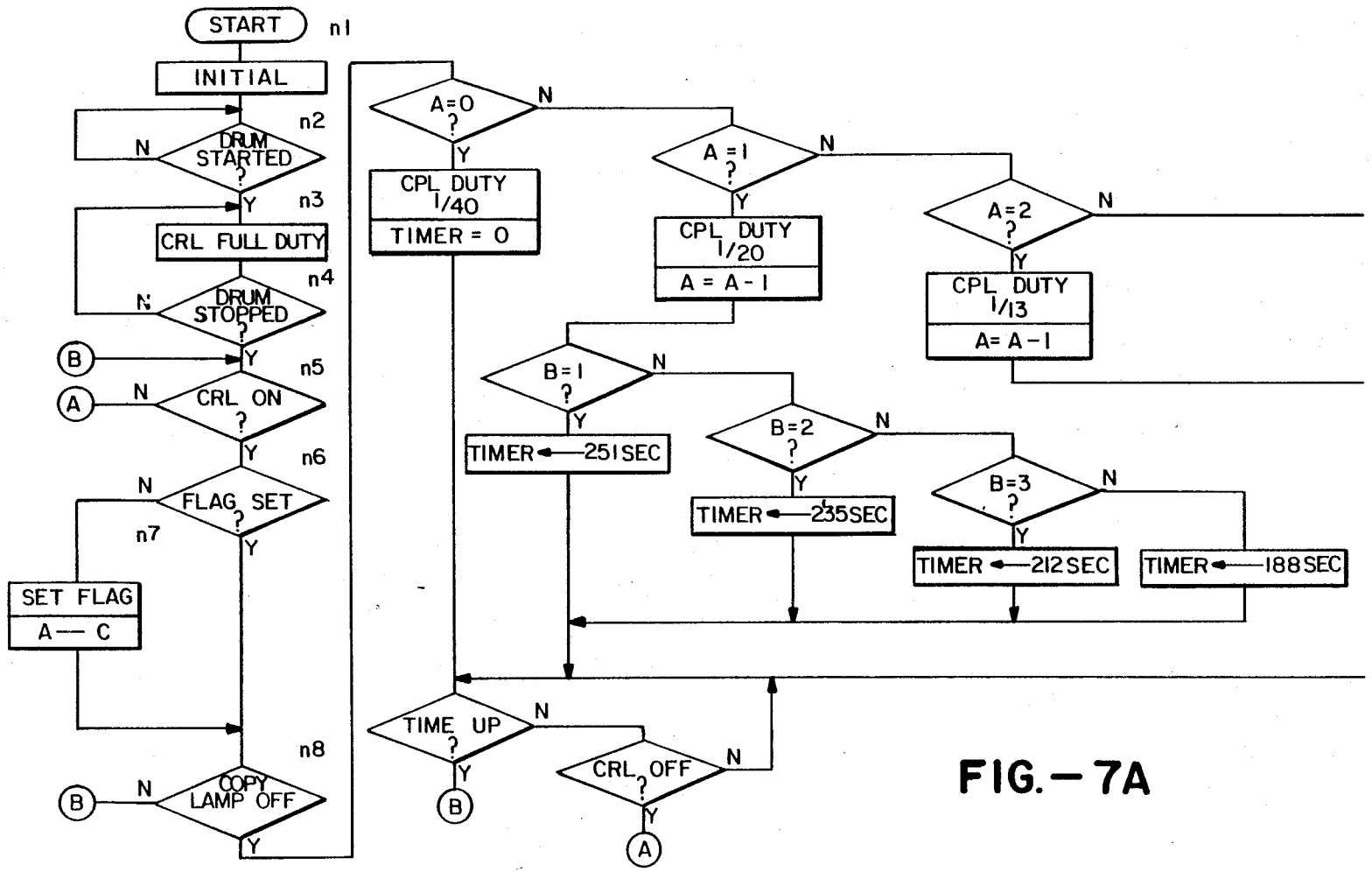
FIG. 7 is a flow chart of the operation of the control unit shown in FIG. 1 in connection with the duty ratio table shown in FIG. 6.
Figure 7B:
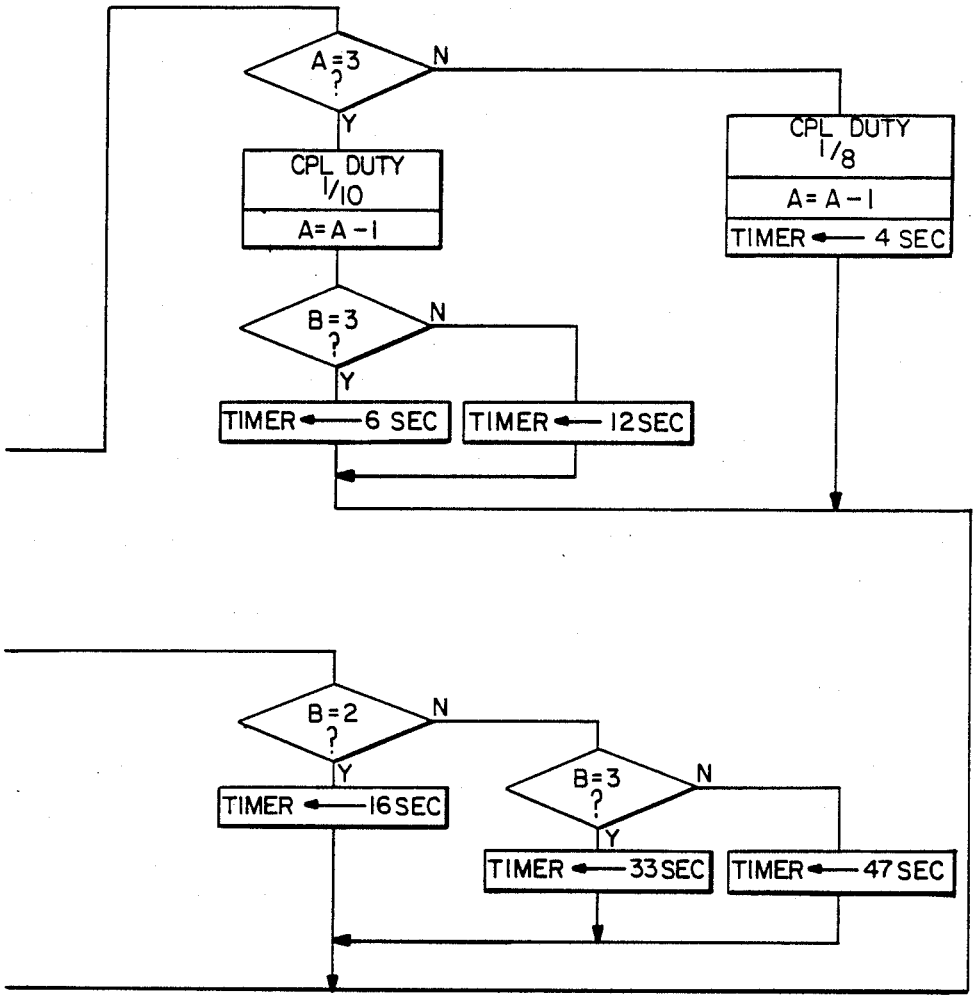

FIG. 7 is a portion of a flow chart of the operation by the control unit when use is made of the table shown in FIG. 6. This flow chart is in part identical to the one shown in FIG. 4 and the steps which are identical are indicated by the same numerals. For continuation to "A" in FIG. 7, reference should be made to FIG. 4.

Although the flow chart of FIG. 7 is more complicated than that in FIG. 4 because periods of continuous operation are partitioned differently, depending on the length of the preceding rest period, the flow chart is self-explanatory in view of the explanation given above with reference to FIG. 4 as well as the table shown in FIG. 6. In summary, the present invention is intended to be broadly construed and such modifications and variations that are apparent to a person skilled in the art are intended to be included within the scope of this invention.

What is claimed is:

1. In a method of stabilizing surface potential of a photoreceptor for electrophotography by exposure of said photoreceptor to charge-removing light before said photoreceptor is uniformly charged at the beginning of an image forming process therewith, the improvement wherein said exposure is started after a rest period, at an initial level determined according to the length of said rest period and the level of exposure of said photoreceptor prior to said rest period, wherein said exposure is gradually reduced from said initial level during a continuous operation of said photoreceptor, and wherein said exposure is reduced by a specified amount when said continuous operation is terminated.

2. The method of claim 1 wherein said exposure is reduced substantially or approximately logarithmically during said continuous operation, and wherein said initial level is increased according to said length of said rest period.

3. The method of claim 2 wherein said initial level is increased more rapidly according to said length of said rest period before the level at the beginning of the preceding operation is reached than thereafter.

4. The method of claim 1 wherein said exposure is reduced during said continuous operation only during a time interval between two successive image forming processes.

5. The method of claim 1 including the step of exposing said photoreceptor to charge-removing light at full duty throughout a warm-up period of said photoreceptor immediately after power is switched on whereby said photoreceptor is completely fatigued.

6. In a method of stabilizing surface potential of a photoreceptor for electrophotography by exposure of said photoreceptor to charge-receiving light before said photoreceptor is uniformly charged at the beginning of an image forming process therewith, the improvement wherein a series of rest intervals with logarithmically varying durations is established, exposure levels are preliminarily assigned individually to said rest intervals, said exposure is started when said photoreceptor is starting after a rest period at an initial level selected from said assigned exposure levels, depending on which one of said rest intervals the length of said rest period belongs to, and wherein a series of continuously operating intervals with logarithmically varying durations is established, exposure levels are preliminarily assigned individually to said operating intervals, said exposure is carried out during a continuous operation at a level selected from said assigned exposure levels, depending on which one of said continuously operating intervals the duration of current continuous operation of said photoreceptor belongs to.

7. The method of claim 6 wherein the number of said continuously operating intervals is variable, depending on the duration of said rest period.

8. The method of claim 6 including the step of exposing said photoreceptor to charge-removing light at full duty throughout a warm-up period of said photoreceptor immediately after power is switched on, whereby said photoreceptor is completely fatigued.

9. The method of claim 6 wherein said exposure is reduced during said continuous operation only during a time interval between two successive image forming processes.

* * * * *